US006839905B1

(12) United States Patent
Bruder et al.

(10) Patent No.: US 6,839,905 B1
(45) Date of Patent: Jan. 11, 2005

(54) SKIN PROTECTION DEVICE FOR FINGERS AND/OR THUMBS

(75) Inventors: William B. Bruder, West Palm Beach, FL (US); John J. Curley, Tyngsboro, MA (US)

(73) Assignee: Brublake Co., LLC, Milwaukee, WI (US)

( * ) Notice: Subject to any disclaimer, the term of this patent is extended or adjusted under 35 U.S.C. 154(b) by 0 days.

(21) Appl. No.: 10/291,464

(22) Filed: Nov. 8, 2002

(51) Int. Cl.[7] ..... A41D 13/00
(52) U.S. Cl. ..... 2/21
(58) Field of Search ..... 2/21, 20, 163, 2/16, 159, 161.1, 161.8, 161.3; 128/880, 878; 223/101; 602/21, 22, 63

(56) References Cited

U.S. PATENT DOCUMENTS

| | | | | | |
|---|---|---|---|---|---|
| 942,003 | A | | 11/1909 | Marsh | |
| 1,257,846 | A | * | 2/1918 | Gregory | 2/21 |
| 1,261,706 | A | * | 4/1918 | Conley et al. | 294/25 |
| 1,483,595 | A | | 2/1924 | Read | |
| 1,887,278 | A | | 11/1932 | Auster | |
| 2,285,981 | A | * | 6/1942 | Johns | 2/21 |
| 2,293,347 | A | | 8/1942 | Lindfelt | |
| 2,389,237 | A | | 11/1945 | Petrullo | |
| 2,474,030 | A | | 6/1949 | Braswell | |
| 2,538,889 | A | * | 1/1951 | Swarin | 2/21 |
| 2,709,257 | A | | 5/1955 | McKinney | |
| 2,740,121 | A | | 4/1956 | Seidel | |
| 2,882,528 | A | | 4/1959 | Tassie | |
| 3,228,033 | A | * | 1/1966 | Ames et al. | 2/21 |
| 3,563,237 | A | * | 2/1971 | Maxwell | 602/58 |
| 3,728,736 | A | * | 4/1973 | Pugh | 2/21 |
| 4,461,043 | A | | 7/1984 | Lomedico | |
| 4,519,097 | A | | 5/1985 | Chappell, Jr. et al. | |
| 4,561,122 | A | | 12/1985 | Stanley et al. | |
| 5,459,883 | A | | 10/1995 | Garceau-Verbeck | |
| 5,500,956 | A | * | 3/1996 | Schulkin et al. | 2/161.1 |
| 5,528,772 | A | | 6/1996 | Cheek | |
| 5,628,068 | A | | 5/1997 | DeLong | |
| 5,711,027 | A | | 1/1998 | Katz et al. | |
| 5,761,745 | A | * | 6/1998 | Sato | 2/161.2 |
| D400,308 | S | | 10/1998 | Paparella et al. | |
| 6,098,200 | A | | 8/2000 | Minkow et al. | |
| 6,182,293 | B1 | | 2/2001 | Mustin | |
| 6,532,963 | B2 | * | 3/2003 | Swanbeck | 128/880 |

* cited by examiner

*Primary Examiner*—Tejash Patel
(74) *Attorney, Agent, or Firm*—Foley & Lardner LLP

(57) ABSTRACT

A protective skin device that may be used to protect the fingers, thumb, and a portion of the hand is provided. The device is configured to be worn about a digit, and the device provides cushioning and aids in gripping. The device includes a sheath with one or more projections, and the sheath may be perforated. The device may include an opening that exposes a joint. The device also may include a palmar pad, which covers a portion of the hand. The device may include multiple sheaths that are connected with a membrane, and multiple devices may be worn on the same or separate digits.

10 Claims, 10 Drawing Sheets

SKIN PROTECTION DEVICE FOR FINGERS AND/OR THUMBS

BACKGROUND

The present application relates generally to the field of skin protective devices, and more particularly, to skin protective devices used to protect at least a portion of a user's hand, (i.e., the fingers, thumb, and palm). The device provides cushioning and aids gripping when the user performs athletic activities such as golf, baseball, or tennis. The device is especially beneficial in preventing blisters and cuts that result from repeatedly gripping a chosen implement.

Athletes involved in sports are constantly exposed to blisters, sores, cuts, and irritations that result from the repetitive use of athletic equipment such as golf clubs, baseball bats, or tennis rackets. Most sports that involve hand-held equipment require that the athlete grasp the equipment firmly to achieve adequate control. Unfortunately, as the athlete repeatedly grasps the equipment, the skin of the fingers or thumb may become abraded, resulting in irritation, cuts, sores, or blisters. To protect the skin, some athletes wear gloves, but many athletes are reluctant to wear gloves because gloves traditionally constrain movement, reduce tactile sensations, and prevent ventilation. Furthermore, gloves also may cause the hands to perspire, which can prevent the athlete from attaining a firm grip on the chosen implement. As such, a device that protects the skin surface, while aiding the user in gripping a chosen implement and permitting movement and ventilation, is desirable.

SUMMARY

A protective skin device is provided. The protective skin device may be positioned over the digits of the hand and, optionally, over at least a portion of the hand, e.g., the palm. The device provides the wearer with protection in the form of protective layer against a grasped object, and the device may also provide cushioning and aid the user in grasping the object. The device may be configured to protect a chosen area of a digit and optionally a portion of the palm, while permitting maximum movement, tactile sensation, and ventilation.

The device commonly includes a sheath that is configured to be worn about at least one digit, such that the digit extends through the sheath. As such, a portion of the digit may be protected while another portion may contact a chosen implement. The sheath may be configured to be worn about the entire digit or, alternatively, about the interior phalanges of the digits, (i.e., the middle and proximal phalanges of the fingers or the proximal phalange of the thumb, wherein the thumb has no middle phalanx). At least a portion of the sheath may span a joint, (e.g., the proximal interphalangeal joint, where the middle and proximal phalanges of a finger are connected), and provide protection of the joint, palm, and/or side of the hand. The sheath generally has two openings for ingress and egress of the digit. Typically, the sheath is elongated and tubular in shape but may be configured in other designs which permit at least a portion of the skin on the hand to be protected. The sheath desirable includes a "palmar face," towards which the fingers curl, and a "dorsal face," which is opposite the "palmar face."

The device includes at least one projection that may be formed into a variety of shapes. Non-exhaustive examples of projections include conical, cylindrical, polygonal, elliptical, tubular, and/or rib-shaped projections. The projection may also form a pattern such as a circle or ridge. The projection may be positioned on the device to achieve the desired cushioning and/or gripping effect, and likewise, where a device contains a plurality of projections, the projections may be arranged in a particular pattern to achieve the desired effect. For example, the projections may be aligned or stacked to create an undulating pattern.

The device also may be configured to achieve the desired ventilation or flexibility. For example, the device may include at least one perforation to facilitate airflow to the digit, and the perforation may be positioned on the device to achieve the desired airflow at least a chosen portion of the digit. The perforation may be large enough to provide an opening, which may expose a portion of the digit, (e.g., a joint). In such an embodiment, the perforation enhances airflow and flexibility. Alternatively, the perforations may be small yet sufficient to provide some ventilation. Where a device contains a plurality of perforations, the perforations may be arranged in a particular pattern. Alternatively, the device may be constructed from material that permits ventilation and/or flexibility, such as a mesh or other breathable fabric or material.

A portion of the device may extend and cover a portion of the hand. For example, the device may include a pad to extend over the palmar face of the metacarpophalangeal joint, (i.e., where the proximal phalanx is connected to the metacarpal). The pad may be enlarged to cover a larger skin surface of the palm or side of the hand. In addition, the pad may include projections to aid in cushioning and gripping.

A single device may be used on multiple digits, and it may be desirable to use multiple devices on the same or different digits. As such, the device may be modular in nature. Where a device includes two sheaths, the sheaths may be connected with a membrane. For example, the two sheaths may be connected side-to-side in order to keep two adjacent fingers in proper alignment, or the two sheaths may be connected end-to-end to permit the sheaths to cover and protect different portions of the same finger.

The device may also be modular in nature, whereby portions can be removed to achieve the desired gripping and protection effect. For example, where a device contains two or more sheaths and/or a pad, a sheath and/or the pad may be removed by the user to achieve the desired effect.

A further understanding of the nature and advantages of the skin protection device disclosed herein may be realized by reference to the remaining portions of the specification and the drawings. It is to be understood that the device is not limited in its application to the details of construction and the arrangements of components set forth in the following description or illustrated in the drawings.

DETAILED DESCRIPTION OF THE PREFERRED EMBODIMENTS

In one embodiment, the device includes a sheath with two holes for ingress and egress of a digit, where the digit protrudes from the sheath. As such, a portion of the digit is protected while another portion may contact the chosen implement such as a golf club, putter, baseball bat, or tennis racket. Typically, the sheath is configured to fit tightly about the digit to prevent abrasion and to provide the maximum tactile sensation. Desirably, the sheath is light-weight and unobtrusive.

Figure 11:
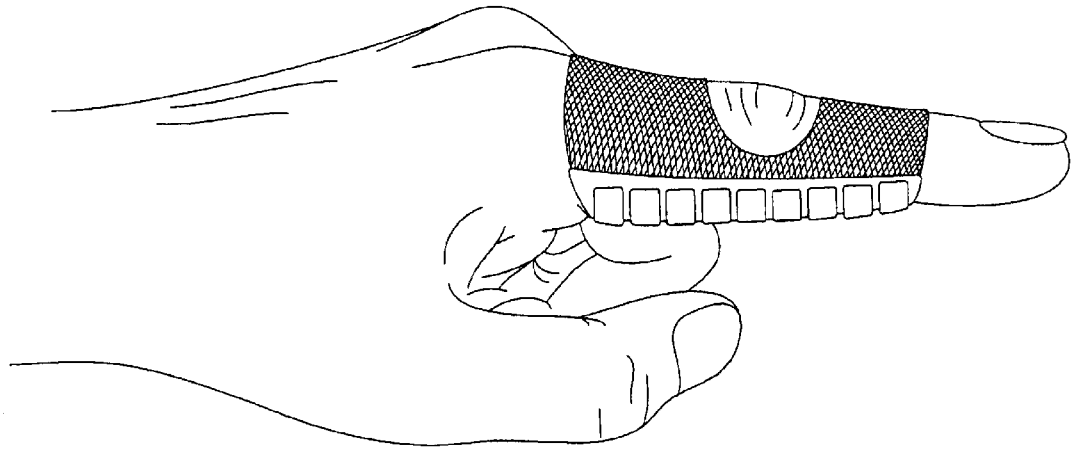
FIG. 11 is a side view of the device shown in FIG. 10 as worn on the proximal and middle phalanges of an index finger.

The device includes at least one projection that extends out from the surface of the sheath. The projection may aid the user in gripping the chosen implement and may also provide additional cushioning. The device may include a plurality of projections for additional gripping/cushioning feel. The projections may be located on a portion of the sheath that is in direct contact with the chosen implement to aid in gripping or cushioning. For example, the projections may be located on the palmar face of the sheath as this is the surface which will grip an implement such as a golf club or baseball bat. Projections of a certain shape, size, or number may be selected to achieve the desired gripping/cushioning effect. Particular shapes may have desirable compression characteristics to cushion the digit and/or aid the user in gripping the implement. Non-exhaustive examples of projection shapes include conical, cylindrical, "polygonal-shaped," (which includes rectangular-, square-, rhomboid-, and trapezoid-shaped), elliptical, tubular, and/or "rib-shaped" projections. Where a device contains a plurality of projections, it may be desirable to arrange the projections in a particular manner. Non-exhaustive examples include aligned or stacked arrangements. Indeed, FIG. 11 shows an arrangement of aligned polygonal projections, while FIGS. 12–20 show a stacked arrangement of rib-shaped projections.

The device may also include at least one perforation through the surface of the sheath which permits airflow and ventilation to the skin, when the sheath is worn on a portion of the hand. The perforation may be a visible hole extending through the sheath or may be smaller and less apparent. In one embodiment, the sheath may be constructed of a "breathable" material, which permits airflow to the digit. Examples of breathable and elastomeric materials may include spandex mesh or LYCRA® brand material. Perforations of a certain shape, size, number, and/or arrangement may be selected to achieve the desired airflow/ventilation. The sheath may also include a large "opening" in the dorsal face of the sheath. This may be particularly desirable where the sheath spans the proximal interphalangeal joint and the opening is large enough to permit the joint to be exposed. As such, the opening may allow the finger to be flexed easily or the joint to expand.

While the sheath has at least one projection and may have at least one perforation, it may be desirable to use a plurality of projections and/or perforations to achieve the desired cushioning/gripping and airflow/ventilation. The projections and/or perforations may be placed about the entire sheath, or it may be desirable to place the projections and/or perforations on a particular face of the sheath. For example, the projections may be placed on the palmar face of the sheath, such that the projections contact the chosen implement to cushion the digit and aid the user in gripping the implement. Likewise, it may also be desirable to locate the perforations on the dorsal face of the sheath to permit airflow and ventilation to the digit. Similarly, it may be desirable to construct the palmar face, the dorsal face, or both faces from a breathable, and flexible material, such as mesh or other breathable/flexible fabric or material, to achieve the desired airflow/ventilation through a chosen portion of the device. In constructing the device, it may be desirable to use a combination of materials to achieve the desired cushioning/gripping and airflow/ventilation. For example, in one embodiment, the surfaces of the device that contact the chosen implement may be constructed from a latex rubber, durable natural or synthetic material, and/or elastomeric material, and the surfaces that do not contact the implement may be constructed from a similar material or a mesh and/or breathable fabric material.

The sheath may also include a "pad" that covers a portion of the hand, such as the metacarpophalangeal joint.

Typically, in this embodiment, the sheath is configured to be worn on the proximal phalanx such that the pad covers at least a portion of the palm, such as the palmar face of the metacarpophalangeal joint. The pad may also contain projections to provide cushioning and aid the user in gripping, and/or the pad may contain perforations. The sheath and the pad may be constructed from the same or different materials. The pad may be connected to the sheath with a membrane.

It may be desirable to wear a plurality of devices, and as such, the device may be modular in nature. For example, it may be desirable to wear devices on more than one digit or more than one phalanx of the same digit. In one embodiment, a device may be worn on both the middle and proximal phalanges of the same finger. In this embodiment, the devices may include two sheaths that are connected with at least one membrane. The membrane may be configured to allow the proximal interphalangeal joint to be exposed, such that the finger may be flexed and/or that the joint may expand easily. In another embodiment, it may be desirable to wear devices of different configurations to achieve the desired cushioning/gripping effect on the chosen implement. Alternatively, it may be desirable to wear a device on a plurality of digits. For example, it may be desirable to wear a device in which two fingers extend through the same sheath, such that the two fingers are conjoined by the sheath.

Where a device contains two or more sheaths and/or a pad, it may be desirable to remove portions of the device to achieve a desired cushioning/gripping effect. For example, a user may choose to tear or cut away a sheath and/or pad. In which case, it may be desirable to manufacture the connecting membrane from material that is easily torn or cut.

Flexibility may be important to achieve the desired grip, and it may be desirable to select a material that is resilient, such that the sheath conforms to the shape of the finger. The device may be constructed from any suitable materials to provide these desired characteristics. Further, it may be desirable to select a material that provides a desirable cushioning/gripping effect. Latex material may provide the sheath with some of these desirable characteristics. The device may also be constructed from natural or synthetic rubber, silicone rubber or other similar such rubber materials. It also may be desirable to use a light-weight material. An exemplary light-weight material includes a woven or knitted fabric, and desirably, the material is elastomeric such as spandex. It also may be desirable to manufacture the device from a flexible and breathable material such as mesh fabric. The fibers of the mesh fabric may be selected to achieve the desired flexibility and ventilation, and the density of the mesh may be varied, where a less dense mesh typically is more flexible and breathable.

Alternatively, it may be desirable to use a combination of materials in order to achieve the desired cushioning/gripping effect and airflow/ventilation effect. For example, SPANDEX material can be woven into a cylindrical shape, then cut and finished to length.. The SPANDEX sleeve could then be pulled over a mandrel and placed along with the mandrel into a mold. The rubber could then be molded into the SPANDEX sleeve to manufacture a device with a spandex dorsal face and a rubber projection on the palmar face.

Figure 1:
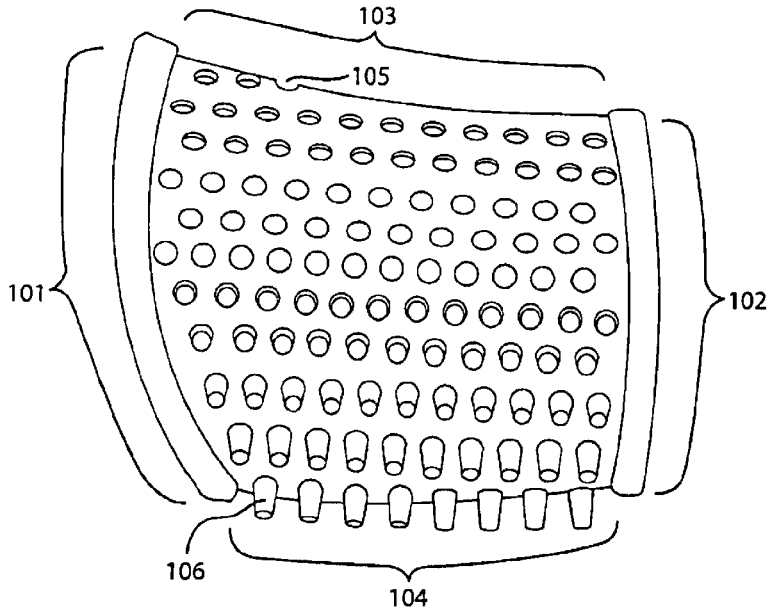
FIG. 1 is a side view of a single-section, skin protection device with palmar, cylindrical projections and dorsal perforations as taught in accordance with the present application.
Figure 2:
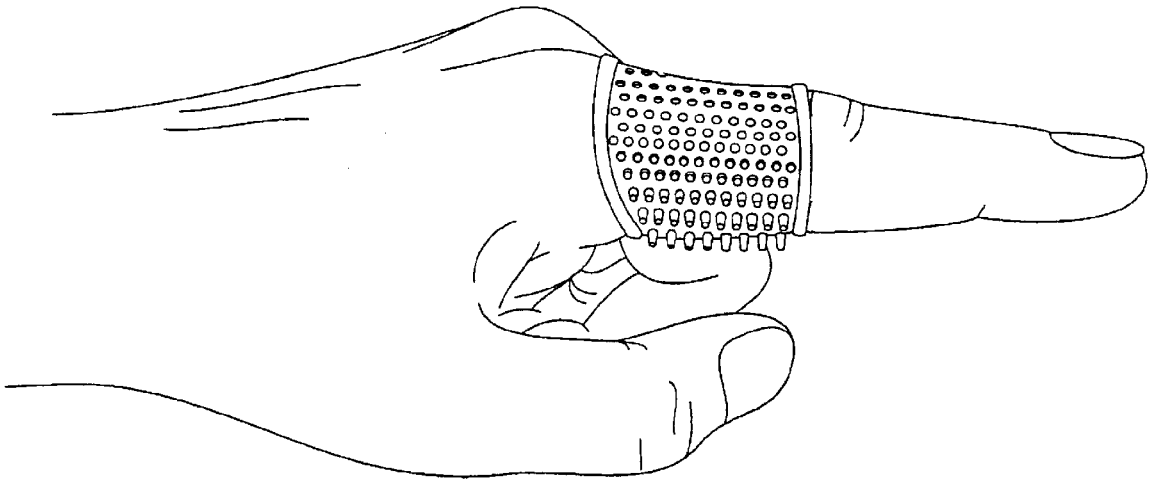
FIG. 2 is a side view of the same device shown in FIG. 1, worn on the proximal phalanx of an index finger.
Figure 3:
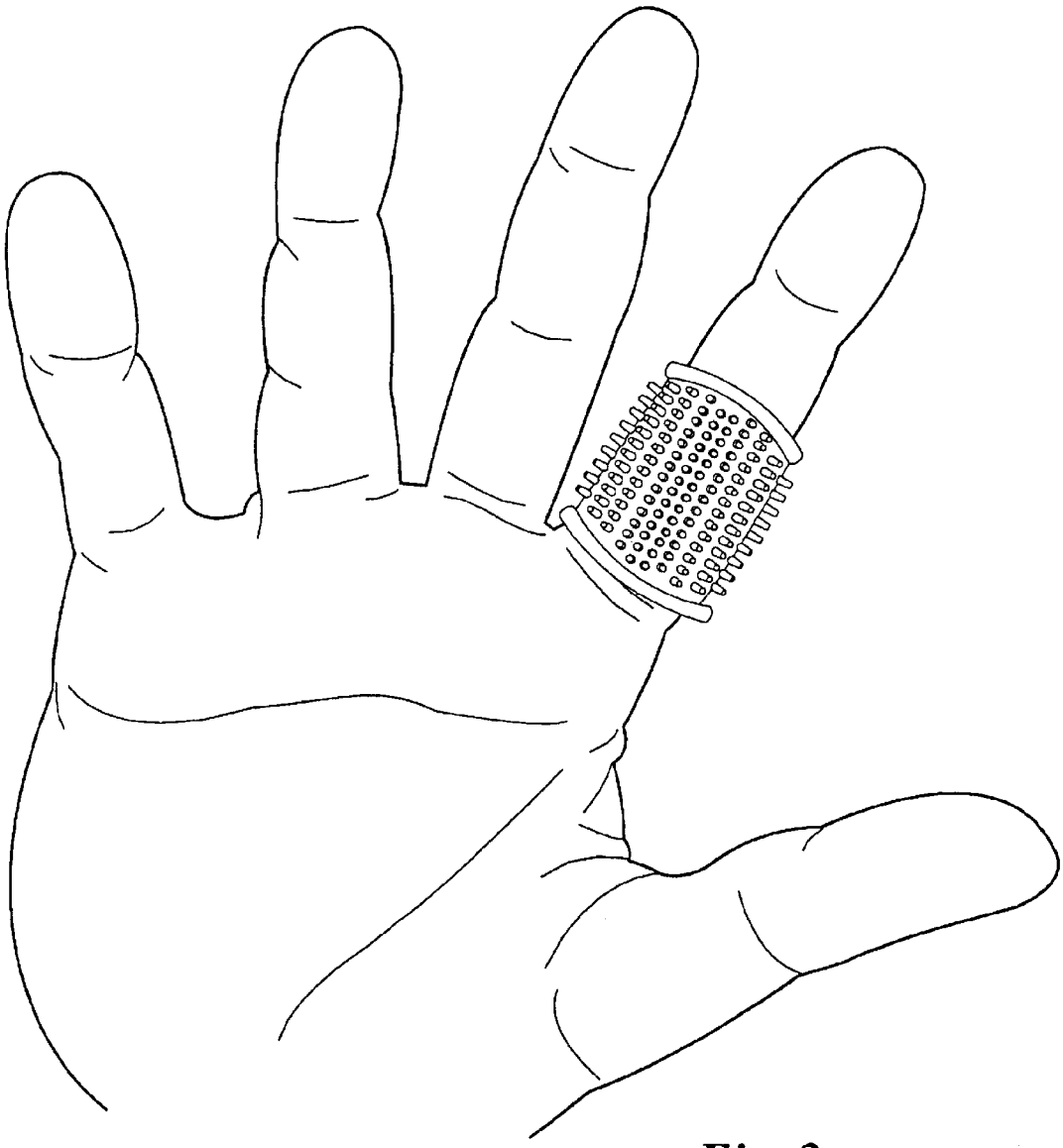
FIG. 3 is a palmar view of a hand in which the device of FIG. 1, including palmar, cylindrical projections, is worn on the proximal phalanx of the index finger.

Now referring to the FIGURES, FIG. 1 shows a skin protection device by example. The device includes a sheath with two openings for ingress 101 and egress 102 of a chosen finger. The sheath has a dorsal face 103 and a palmar face 104. The sheath has circular perforations 105 in the dorsal face and cylindrical projections 106 on the palmar face. FIG. 2 (side view) and FIG. 3 (palmar view) show the device as worn on an index finger.

Figure 4:
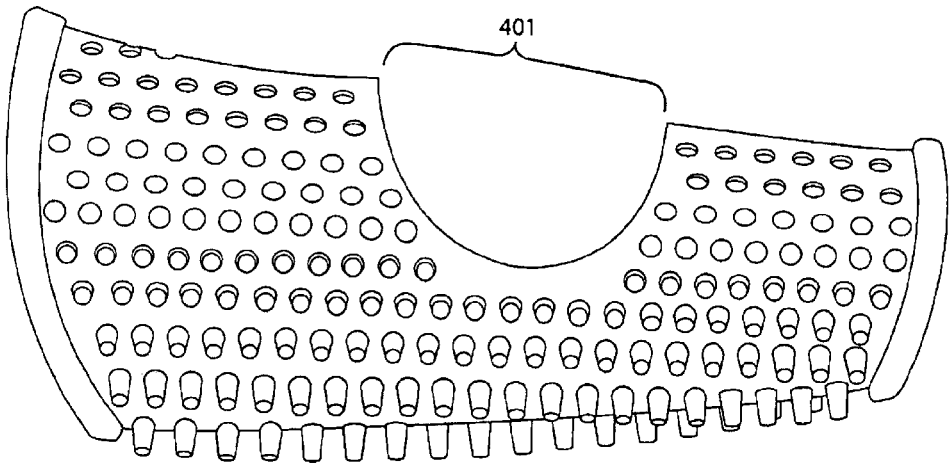
FIG. 4 is a side view of a device configured to be worn on the proximal phalanx and the middle phalanx with an opening that exposes the proximal interphalangeal joint as taught in accordance with the present application.
Figure 5:
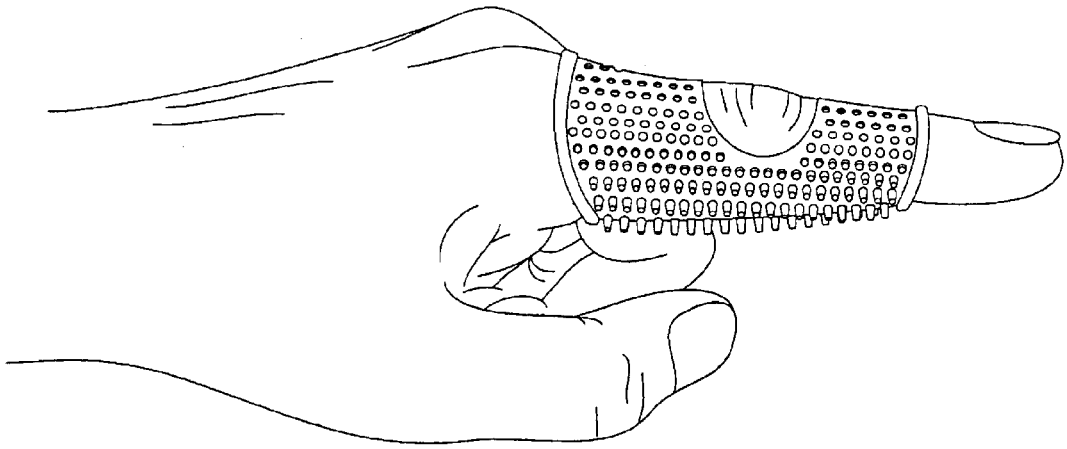
FIG. 5 is a side view of the device shown in FIG. 4 as worn by a user on an index finger.
Figure 6:
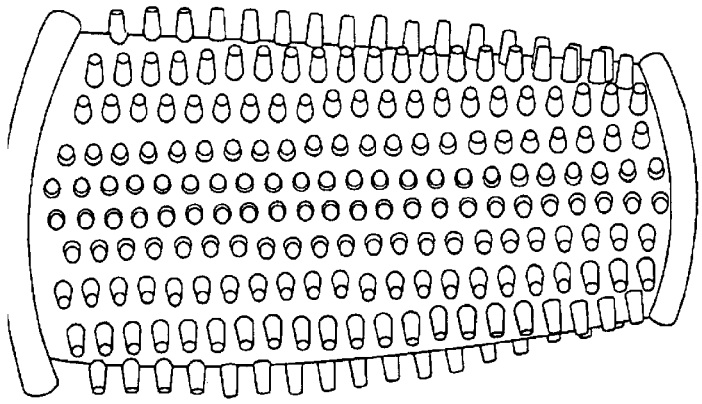
FIG. 6 is a palmar view of the device shown in FIG. 4.
Figure 7:
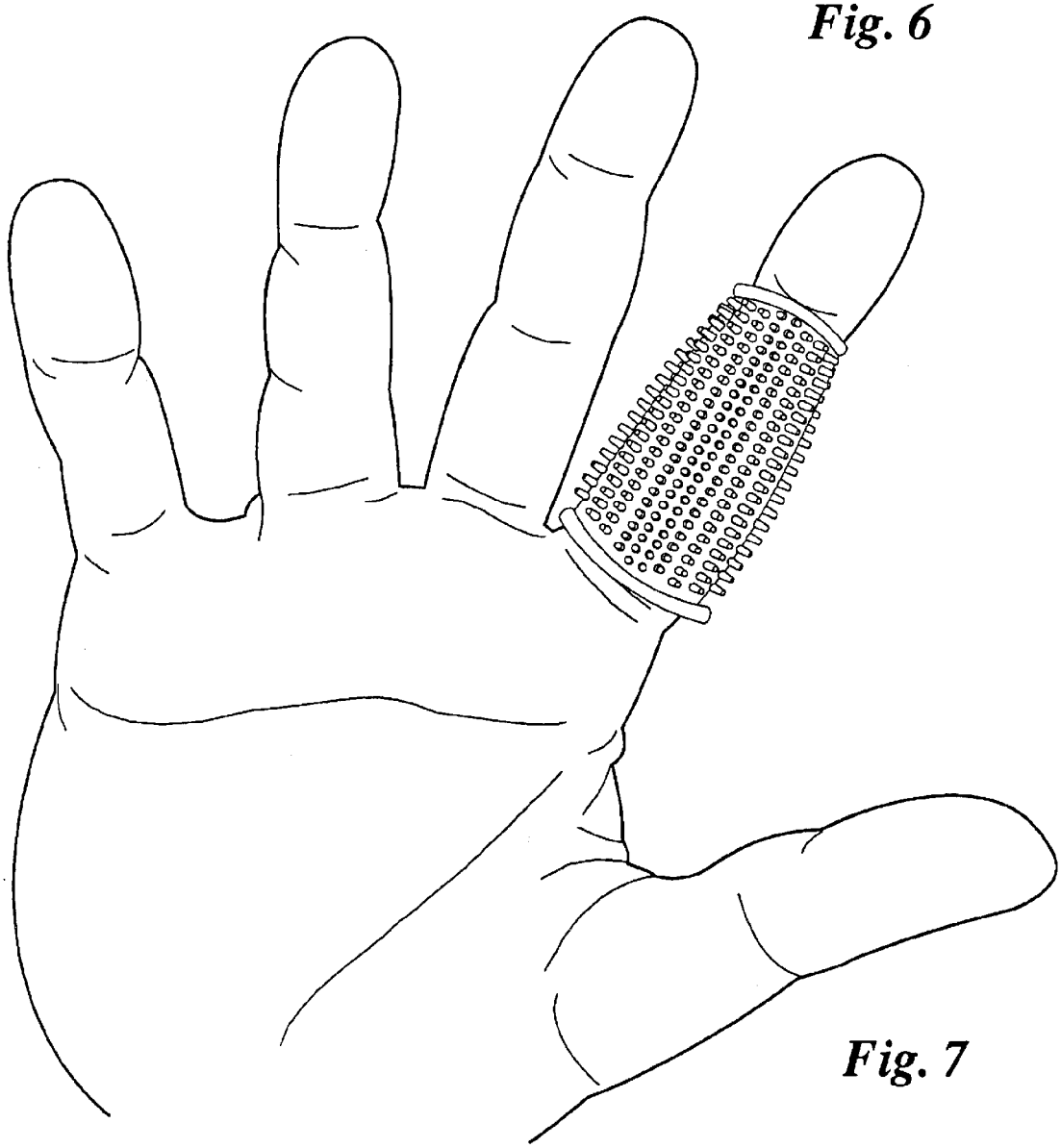
FIG. 7 is a palmar view of the device shown in FIG. 4 as worn on the proximal and middle phalanges of an index finger.

FIG. 4 is another embodiment of the device that is configured to be worn about both the middle and proximal phalanges. As such, the device spans the proximal interphalangeal joint and contains an opening 401 that exposes the joint as shown in FIG. 5 (side view) to permit the finger to be flexed and/or the proximal interphalangeal joint to be flexed easily. The opening 401 may not be necessary if the dorsal face of the sheath, of the entire sheath is made from a flexible material. The shown device includes conical projections. The sheath may include the perforations only on the dorsal face as shown in FIGS. 4–7, although perforations may be placed throughout the sheath.

Figure 8:
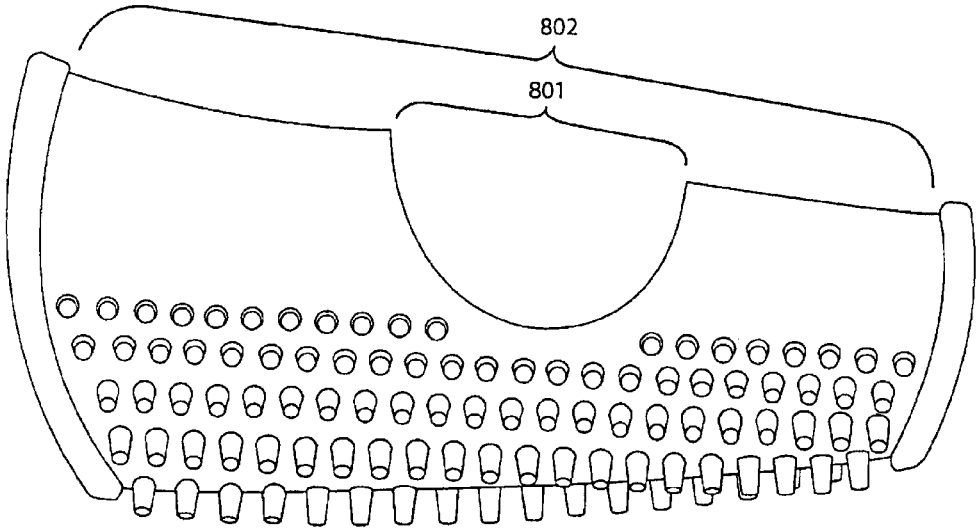
FIG. 8 is a side view of a device with an opening to expose the proximal interphalangeal joint but without additional perforations as taught in accordance with the present application.
Figure 9:
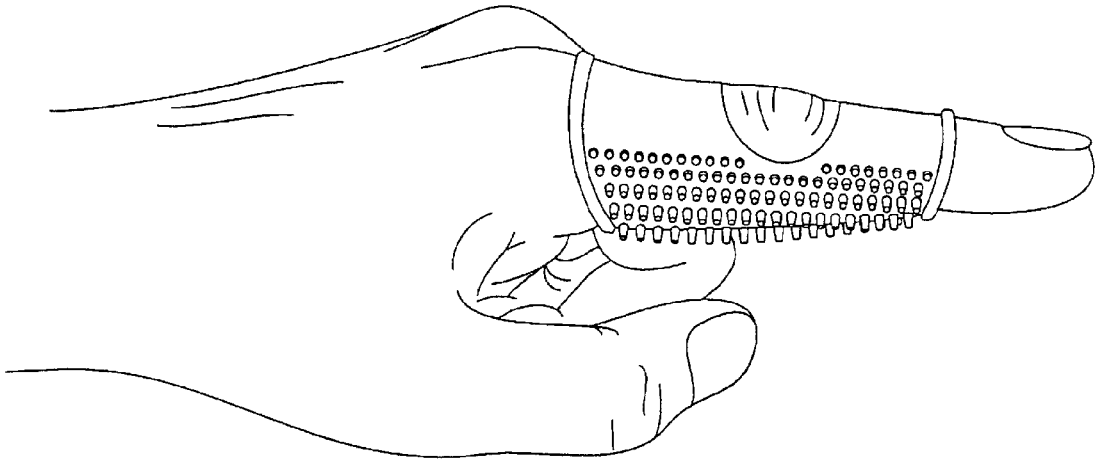
FIG. 9 is a side view of the device shown in FIG. 8 as worn on the proximal and middle phalanges of an index finger.

FIG. 8 shows a device that is configured to be worn about both the middle and proximal phalanges and to span the proximal interphalangeal joint. The device has an opening 801 that exposes the joint as in FIG. 4, but this device has no additional perforations on the dorsal face 802 of the sheath, although perforations may be placed throughout the sheath. FIG. 9 shows a side view of the device in FIG. 8 as worn on an index finger.

Figure 10:
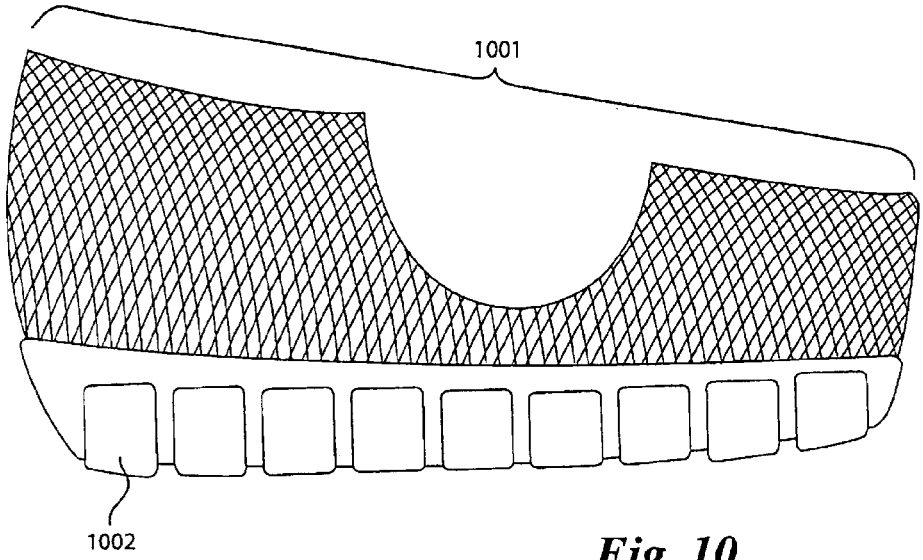
FIG. 10 is a side view of a device including a sheath with rectangular projections on the palmar face and breathable, elastomeric woven mesh material on the dorsal face as taught in accordance with the present application.

FIG. 10 shows a device that is configured to be worn about both the middle and proximal phalanges and to span the proximal interphalangeal joint. The device has an opening that exposes the joint as in FIG. 4 and FIG. 8. The device in FIG. 10 includes a material on the dorsal face of the sheath 1001. The material may include a breathable fabric such as mesh, and the material may be elastomeric. The shown device also includes rectangular-shaped projections on the palmar face 1002. The projections may be arranged in a stacked configuration as shown, or may be arranged in other configurations apparent to one skilled in the art. FIG. 11 shows the device in FIG. 10 as worn on an index finger.

Figure 12:
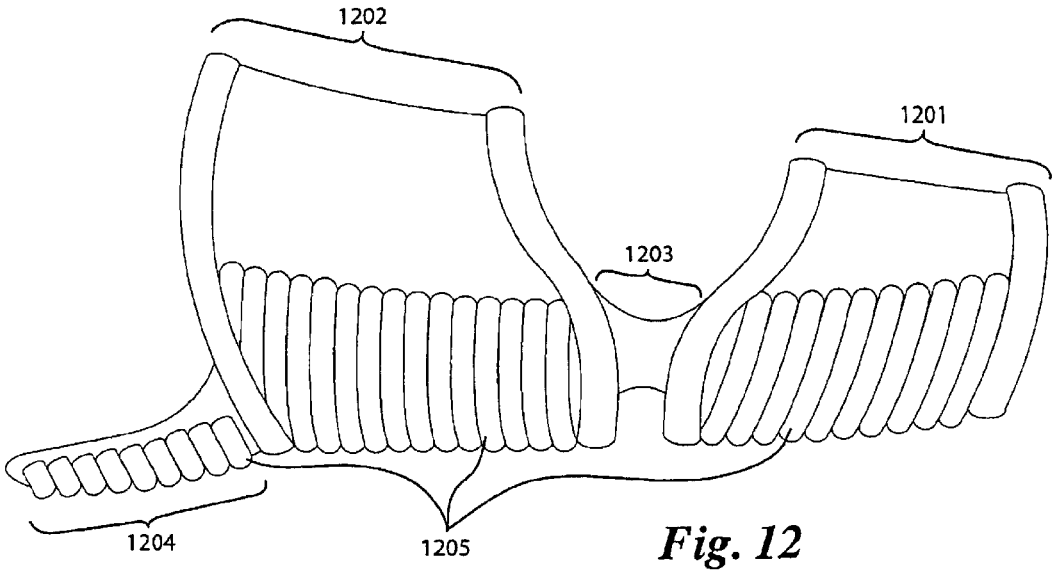
FIG. 12 is a side view of a device that includes two sheaths with rib-shaped projections, a membrane that connects the two sheaths, and a palmar pad connected to the sheath that is configured to be worn on the proximal phalanx as taught in accordance with the present application.
Figure 13:
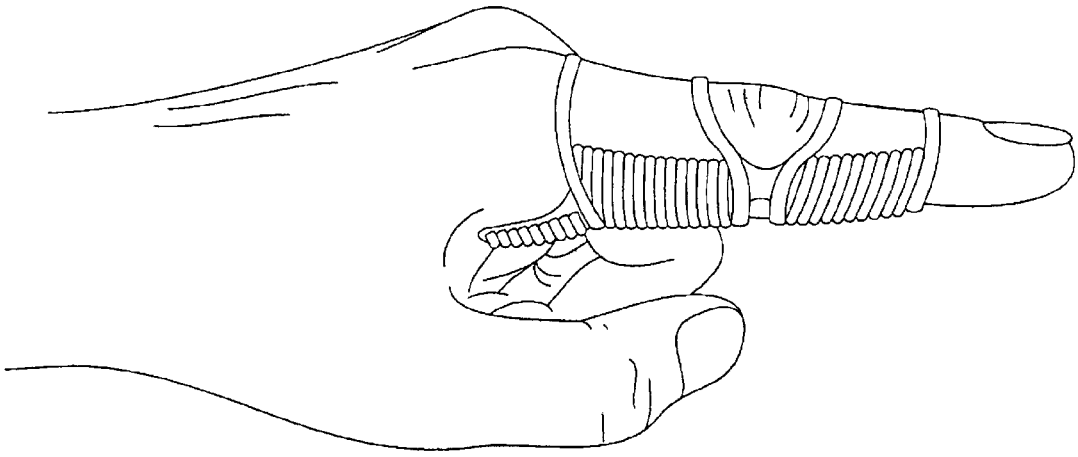
FIG. 13 is a side view of the device shown in FIG. 12 as worn on the proximal and middle phalanges of an index finger.

FIG. 12 shows a device that is configured to be worn about both the middle and proximal phalanges and to span the proximal interphalangeal joint. The device includes two sheaths 1201 and 1202, which are configured to be worn about the middle phalanx and the proximal phalanx, respectively. The two sheaths may be connected by at least one membrane 1203. The membrane may be stretchable and/or flexible, and may be durable enough to withstand repetitive removal and placement of the device from the hand or digit. In a preferred embodiment, the device includes a palmar pad 1204 that is connected to the sheath that is configured to be worn about the proximal phalanx. The two sheaths and the palmar pad include rib-shaped projections 1205 but no perforations, but may have perforations if desired. The dorsal side may be constructed from the same material, or it may be a breathable fabric as well. This may have perforations. FIG. 13 shows a side view of the device in FIG. 12 as worn on an index finger, in which the palmar pad extends and covers a portion of the palmar face of the metacarpophalangeal joint. The palm pad may be larger to cover a larger portion of the palm, and the pad may be placed to protect the side of the hand.

Figure 14:
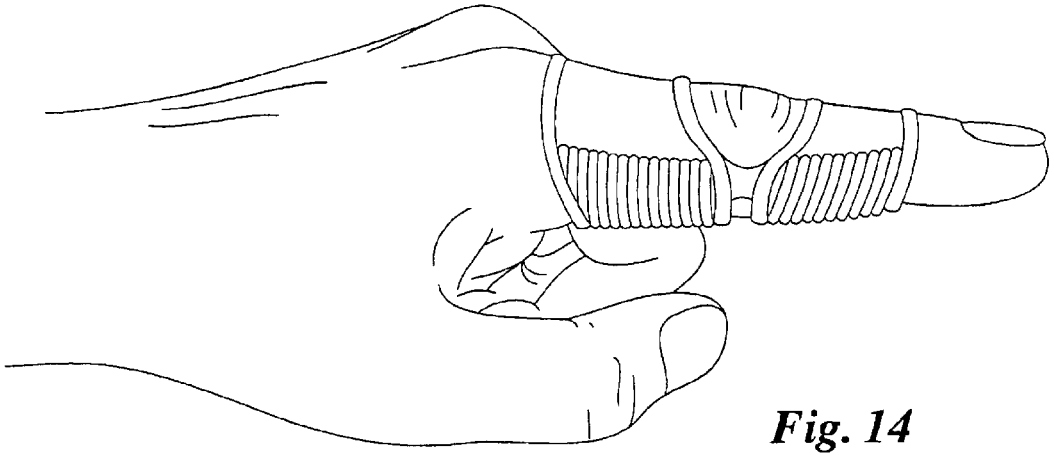
FIG. 14 is a side view of a device without a palmar pad as taught in accordance with the present application.
Figure 15:
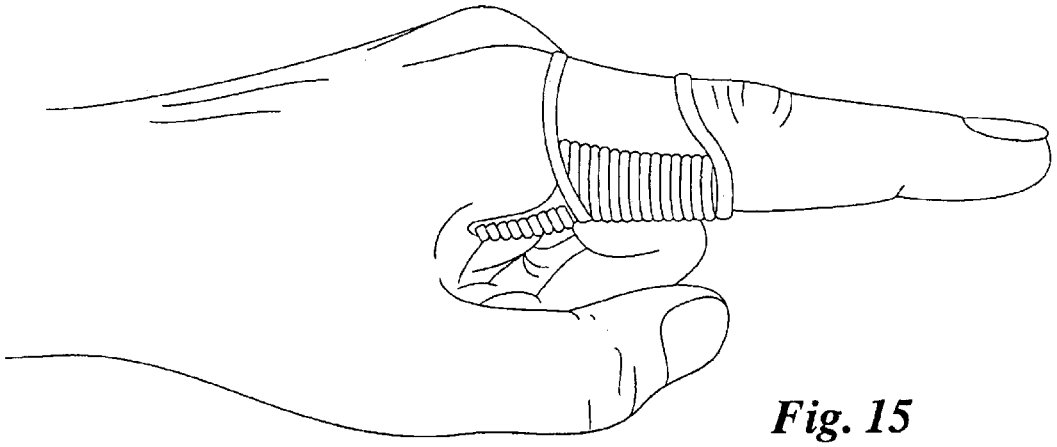
FIG. 15 is a side view of a device including a sheath with rib-shaped projections and a palmar pad, as worn on a proximal phalanx of an index finger as taught in accordance with the present application.
Figure 16:
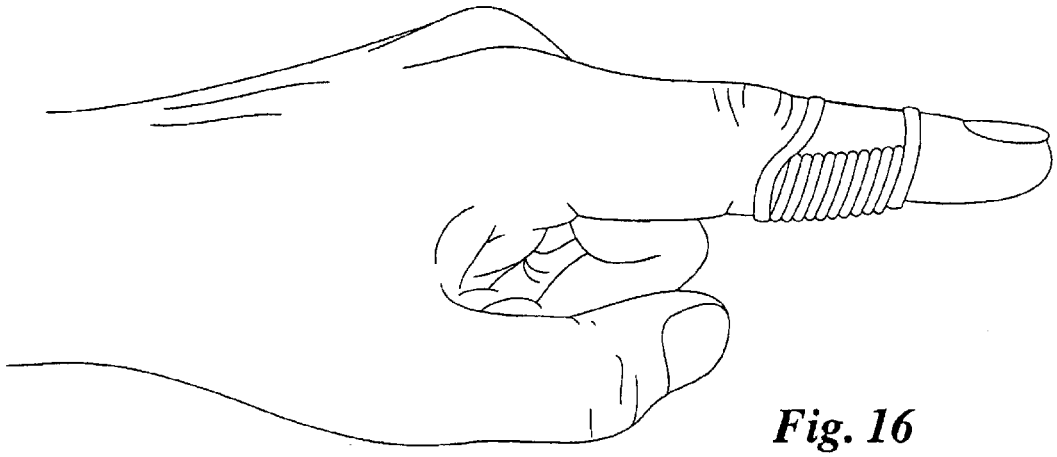
FIG. 16 is a side view of a device including a sheath with rib-shaped projections, as worn on a middle phalanx as taught in accordance with the present application.

The device may be positioned on various portions of the hand. For example, FIG. 14 shows a side view of the device in FIG. 12 without a palmar pad, as worn on an index finger. Alternatively, FIG. 15 shows a side view of a device with rib-shaped projections and a palmar pad, as worn on a proximal phalanx of an index finger. In another embodiment, FIG. 16 shows the side view of a device with rib-shaped projections as worn on the middle phalanx of an index finger.

Figure 17:
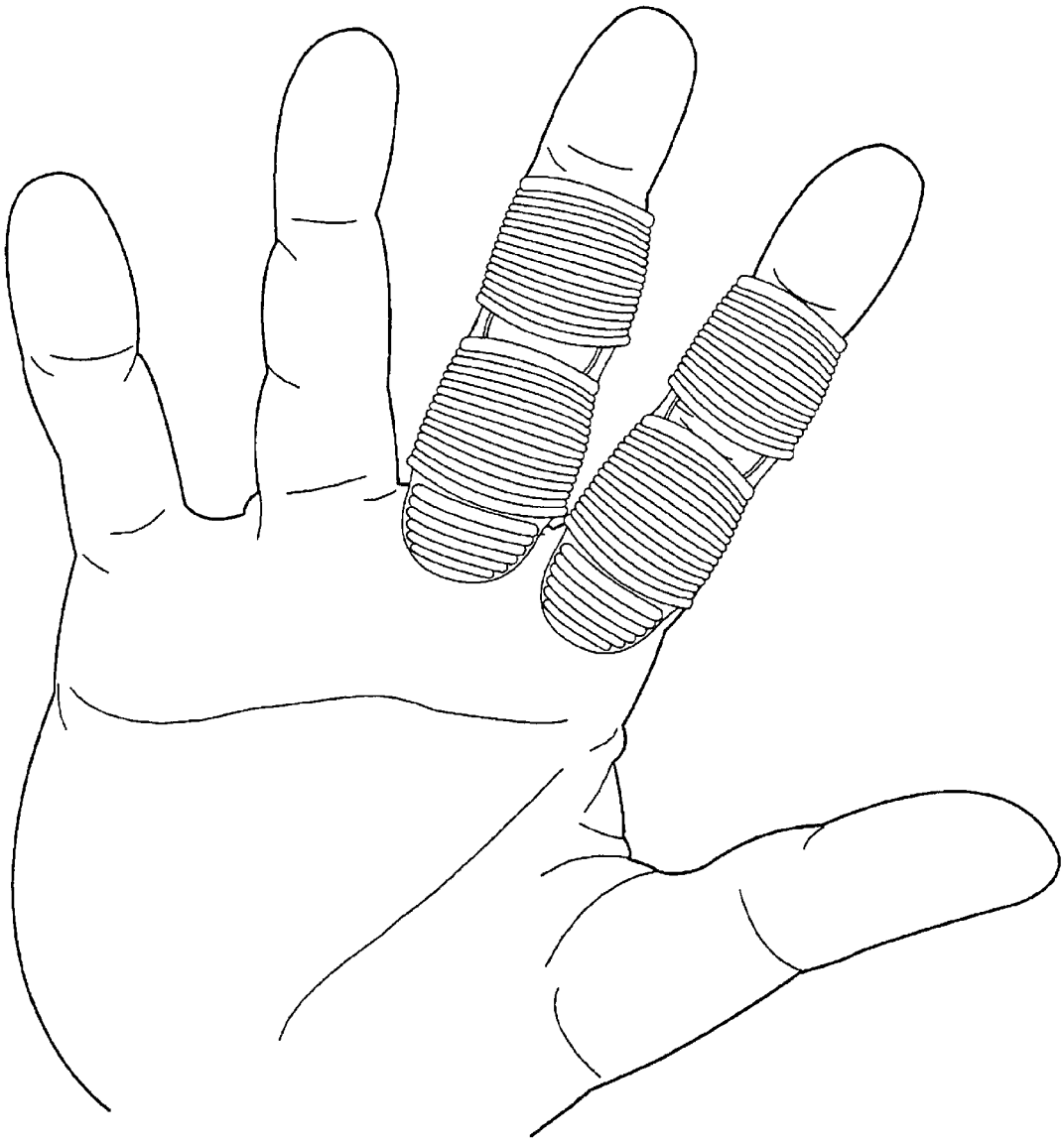
FIG. 17 is a palmar view of the device in FIG. 12, as worn on the proximal and middle phalanges of the index and middle fingers.
Figure 18:
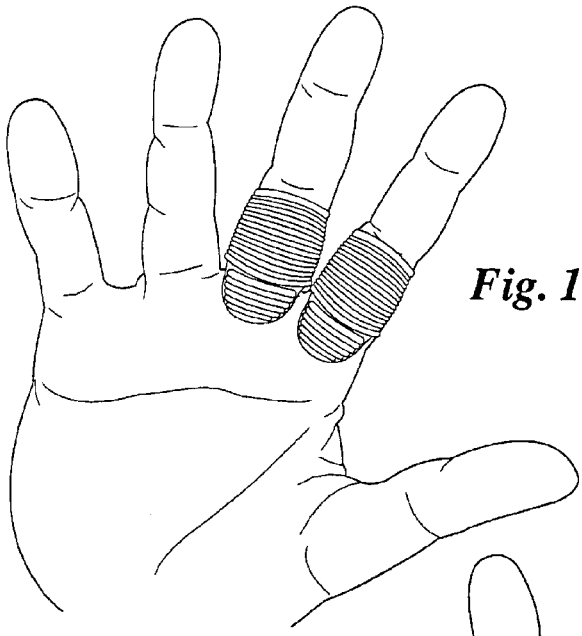
FIG. 18 is a palmar view of the device in FIG. 15, as worn on the proximal phalanges of the index and middle fingers.
Figure 19:
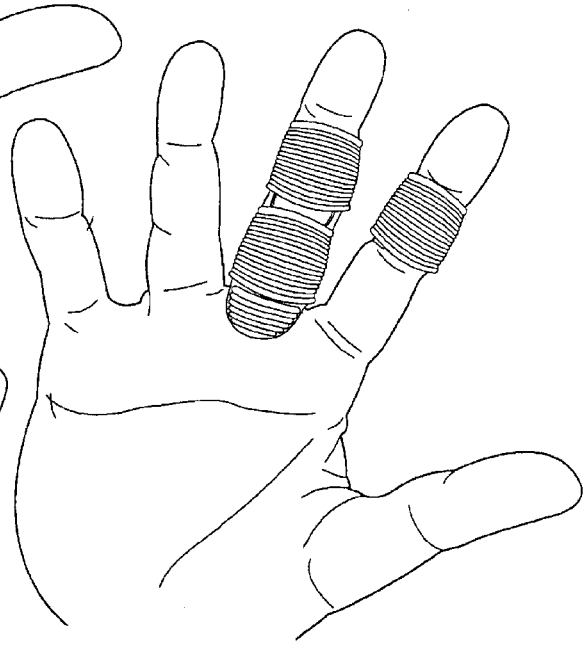
FIG. 19 is a palmar view of the device in FIG. 12, as worn on the proximal and middle phalanges of the middle finger, and the device in FIG. 16, as worn on the middle phalanx of the index finger.
Figure 20:
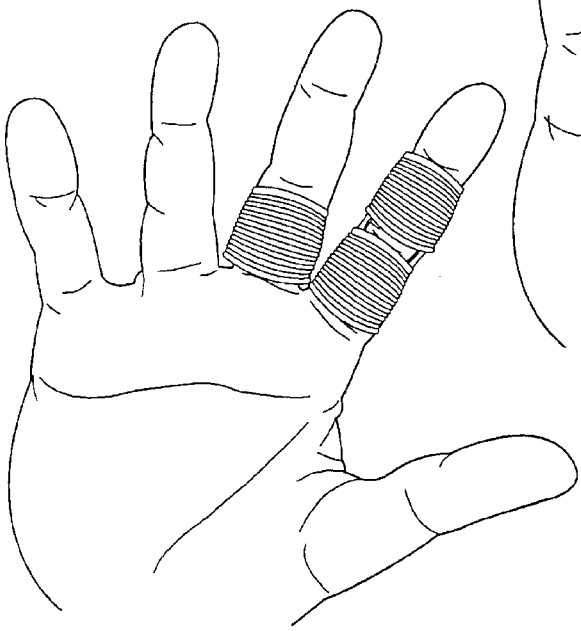
FIG. 20 is a palmar view of the device in FIG. 12, as worn on the proximal and middle phalanges of the index finger, and the device in FIG. 16, as worn on the proximal phalanx of the middle finger.

The device also may be worn on multiple fingers as shown in FIG. 17, showing a palmar view of the device in FIG. 12 as worn on the index finger and the middle finger. FIGS. 18,

19, and 20 show palmar views of multiple devices being worn on the index and middle fingers. The devices may be worn freely, or may also be connected by a membrane to hold two fingers in a desired position (not shown).

The device has been described with reference to various specific embodiments and techniques. The examples described herein illustrate but do not limit the scope of the invention that has been set forth herein. It should be noted that the description of various embodiments provided in the this disclosure may be of overlapping scope. The embodiments discussed in this disclosure are merely illustrative and are not meant to limit the scope of the present invention, or equivalents thereof. It should be understood that many variations and modifications may be made while remaining within the spirit and scope of the invention.

What is claimed is:

1. A skin protection device for fingers and/or thumbs, comprising:

at least one sheath having a palmar face and a dorsal face, wherein the sheath is configured to be worn on at least one of a user's digits such that a distal end of the digit protrudes through the sheath;

at least one projection is substantially placed on the planar face that extends outward from the sheath, wherein the projection is configured to cushion the digit when the user grips a chosen implement; and at least one perforation that is substantially placed on the dorsal face wherein the device is not configured to cover the user's palm.

2. The device of claim 1 further comprising a plurality of sheaths.

3. The device of claim 1 further comprising a second sheath and a membrane, wherein the membrane connects the first and second sheaths.

4. The device of claim 1 wherein the sheath is configured to be worn on at least two digits.

5. The device of claim 1 wherein the sheath is configured to be worn on at least one of a middle and a proximal phalanx of a digit.

6. The device of claim 1 further comprising a breathable material.

7. The device of claim 1 wherein at least a portion of the dorsal face is constructed from material to permit airflow therethrough.

8. The device of claim 1 further comprising a plurality of projections that are substantially conical, cylindrical, polygonal, elliptical, tubular, or rib-shaped.

9. The device of claim 1 further comprising an opening that exposes a joint of the digit.

10. A method of using a skin protection device for fingers and/or thumbs in sports which comprises covering at least a portion of a digit with a device comprising:

at least one sheath having a palmar face and a dorsal face, wherein the sheath is configured to be worn on at least one of a user's digits such that a distal end of the digit protrudes through the sheath;

at least one projection is substantially placed on the palmar face and that extends outward from the sheath, wherein the projection is configured to cushion the digit when the user grips a chosen implement and at least one perforation that is substantially placed on the dorsal face;

wherein the device is not configured to cover the user's palm.

* * * * *

UNITED STATES PATENT AND TRADEMARK OFFICE

CERTIFICATE OF CORRECTION

PATENT NO. : 6,839,905 B1 
DATED : January 11, 2005
INVENTOR(S) : William B. Bruder and John J. Curley It is certified that error appears in the above-identified patent and that said Letters Patent is hereby corrected as shown below:

Column 7,
Line 23, after "placed on the planar" delete "planar" and insert -- palmar --.
Line 24, after "face" insert -- and --.
Line 26, after "a chosen implement;" delete ";".
Line 27, after "the dorsal face" insert -- ; --.

Signed and Sealed this

Seventeenth Day of May, 2005

JON W. DUDAS
*Director of the United States Patent and Trademark Office*